United States Patent [19]

Minayoshi et al.

[11] Patent Number: 4,725,318

[45] Date of Patent: Feb. 16, 1988

[54] FILLER FOR PAPER-MAKING AND NEUTRAL PAPER-MAKING PROCESS BY THE USE THEREOF

[75] Inventors: Shiro Minayoshi; Naofumi Saitoh, both of Akashi; Minoru Hanazaki; Hiroyuki Hisakuni, both of Kobe; Noritsugu Ebisuya, Akashi, all of Japan

[73] Assignee: Maruo Calcium Company, Limited, Hyogo, Japan

[21] Appl. No.: 830,809

[22] Filed: Feb. 19, 1986

[30] Foreign Application Priority Data

Feb. 19, 1985 [JP] Japan ..... 60-30707
Nov. 13, 1985 [JP] Japan ..... 60-254427

[51] Int. Cl.[4] ..... C04B 14/28

[52] U.S. Cl. ..... 106/306; 162/181.1; 162/181.2

[58] Field of Search ..... 106/307, 306, 286.8; 162/181.2, 181.1

[56] References Cited

U.S. PATENT DOCUMENTS 4,181,567 1/1980 Riddell et al. ..... 162/168.3

OTHER PUBLICATIONS

Stark et al; Wochenblatt Fur Papierfabrikation 9, 1981.

*Primary Examiner*—Amelia Burgess Yarbrough
*Attorney, Agent, or Firm*—Armstrong, Nikaido, Marmelstein & Kubovcik

[57] ABSTRACT

The present invention provides a filler for paper-making containing 0.1 weight part or more of a particle composition meeting the requirements (A), (B) and (C) below per 100 weight parts of heavy calcium carbonate and a neutral paper-making process by the use thereof:

(A): Zeta potential (Suspension concentration 1,000 ppm in pure water, measuring temperature 20° C.) is negative;

(B): Particle size "d" of the composition resulting from dispersion for 10 minutes of a 10 weight % aqueous suspension of the above-mentioned particle composition by ultrasonic dispersing means measured by the use of the standard sieve of JIS Z8801 is:

$$22\ \mu m < d \leqq 150\ \mu m$$

(C): Specific surface area S ($cm^2/g$) of the above-mentioned particle composition measured by the BBT method is within the range shown by the formula (1) below:

$$S > 100{,}000/D \cdot \rho \quad (1)$$

where:

D = Average particle size ($\mu m$) of the composition $\rho$ = Specific gravity of the composition.

According to the present invention the abrasive wear of plastic wires can be dramatically reduced.

2 Claims, 17 Drawing Figures

FILLER FOR PAPER-MAKING AND NEUTRAL PAPER-MAKING PROCESS BY THE USE THEREOF

BACKGROUND OF THE INVENTION

1. Field of the Invention

The present invention relates to a filler for paper-making and a neutral paper-making process by the use thereof. More particularly it relates to a filler composition which is cheap and extremely good with regard to abrasive wear of plastic wire and to a paper-making process by the use thereof.

2. Description of the Prior Art

There are two alternative kinds of paper-making process according to the kind of sizing agent etc. used, namely the acid process and the neutral process.

These two paper-making processes are distinguished from each other by the sizing agent, fixing agent and filler used. There are advantages as well as disadvantages in the quality of the paper made, but so far the greater part is practiced by the acid process by reason of the total cost as well as technical problems, the neutral paper-making process being used only partly.

In the acid paper-making process rosin is used as sizing agent and aluminum sulfate (normally called alum) as fixing agent. This is an economically as well as technically advantageous process in that both rosin and aluminum sulfate are cheap and aluminum sulfate plays an important role throughout the paper-making process, being not only effective for fixing of the rosin size but also effective for prevention of slime formation and pitch deposition in the paper-making equipment. Further, in this acid paper-making process characteristic is the use of filler. As filler kaolin, clay, titanium dioxide etc. are used, and aluminum sulfate contributes to improvement of the yield of these fillers. These fillers are, however, economically problematic, good talc, for instance, being difficult to obtain in Japan and titanium dioxide being inevitably expensive for its complicated process of manufacture. Moreover, since the paper made by the acid paper-making process is acidic, it is bound to be humid, and with the resultant increase of the paper's water content, increased is the amount of hydrogen ion so that the carbohydrate becomes subject to oxidation and hydrolysis, while it is also subject to decomposition and modification by other ions, this resulting in the paper's increased rate of deterioration, and for this reason papers made by the acid paper-making process have been accepted to be less suited for use where stability in prolonged storage is essential such as paper for books e.g. encyclopoedia and official documents. Also, since in the case of acid paper-making the paper-making process is conducted normally in a pH range of 4–5, the paper-making machine and other metal parts are highly subject to corrosion.

Neutral paper-making process, on the other hand, is a process in which a neutral sizing agent of the type alkyl ketene dimer or alkyl succinic acid, cationic fixing agent and emulsifier are used so that the pH of white water, the material for paper-making, is adjusted to not less than 7, also called the "alkaline paper-making process."

Calcium carbonate has been known as being equally effective compared with the above-mentioned filler with regard to its effect to improve paper's whiteness, opacity, smoothness, affinity for ink, writing property and coating property etc. Although it is available domestically amply and cheaply, it cannot be used in the acid paper-making process as it enters into a chemical reaction with aluminum sulfate. In this neutral paper-making process, however, calcium carbonate can be used, and actually Indian paper, rice paper and back-carbon paper etc. are being manufactured with calcium carbonate as filler. Adoption of this neutral paper-making process not only means improvement of paper quality such as improvement in whiteness and intransparency and prevention of deterioration of the paper quality but also cost merit due to increase of the paper's ash content, for equally good paper quality is attainable even when the filler content is increased 33–5% compared with acid-manufactured paper. Other advantages are decrease of beating power, improvement of reutilization of white water due to decrease of separating salts, decrease in amount of steam required for heating fresh water due to improvement of white water reutilization rate, decrease of specific energy consumption due to decrease of depositing lees of wet parts etc. attributable to decrease of separating salts and also operative advantage. Furthermore, in the field of paper coating, higher concentration of coating color has been sought for improvement of the physical properties of coated paper and lowering of the energy cost, and as coating material heavy calcium carbonate in fine particle size is now being used progressively in combination with a lot of kaolin. When the waste portion of such coated paper having coated thereon a high specific amount of heavy calcium carbonate (waste from the paper-making process, finishing process etc.) is reclaimed by the acid paper-making process, calcium carbonate enters into chemical reaction with the acid contained in aluminum sulfate to cause foaming due to generation and separation of carbon dioxide, hence inside filler size treatment by rosin-aluminum sulfate system becomes difficult or there results sedimentation-solidification of the resulting calcium sulfate etc. in the vessel or pipe interior to possibly induce unexpected trouble in the fluid forwarding process and other operative steps.

For the above-mentioned steps a switchover from the acid paper-making process to the neutral counterpart is desired. The neutral sizing agent used for this neutral paper-making process is still extremely expensive compared with rosin-aluminum sulfate despite the studies from various sides for reducing its cost, this being the only cost-raising factor for the neutral paper-making process which is aimed at cost-saving, and switchover to neutral paper-making process is difficult unless an effort is made in earnest for saving of the total cost by the use of a filler as cheap as possible. If cheap calcium carbonate is used as filler, there arises a problem of abrasive wear of wires of the paper-making machine as stated below.

In recent years, with the paper-making machine increasing in scale as well as in operating speed, there has been a growing interest in wire life from the viewpoint of productivity as well as workability. To cope with the growing interest, plastic wire was developed, and put to practical use beginning since late in 1960s, and today plastic wire has been almost standardized for large-scale machines, and it is now being used also for medium-small machines. The reason for the progressive adoption of plastic wire in place of bronze wire is for plastic wire's advantage over bronze wire with regard to fatigue life, safety from corrosion and easiness required for maintenance. Moreover, the abrasive effect of talc and kaolin mainly used as filler for the acid paper-making process is much less on plastic wire than on bronze wire, the life of the plastic wire in the process thus being 5–10 times longer than that of the bronze wire. Things are, however, different if calcium carbonate is used as filler instead of talc, kaolin etc. So, when neutral paper-making is carried out on a paper-making machine with calcium carbonate as filler, calcium carbonate's abrasive wear of plastic wires is different from that of talc or kaolin, and its abrasive effect on plastic wires is higher than on bronze wires, this resulting in a marked adverse effect on working efficiency of the neutral paper-making process. Since badly abrased wire has to be replaced with a new one with the paper-making machine being stopped, this badly affects the machine's productivity. Generally abrasive wear of plastic wires by the filler depends largely on the kind of filler used as well as on its particle size and form: the abrasive wear of wires is more marked with increasing particle size of the filler and with increasing number of knife edge-like projections on the surface of particles.

There are two alternatives to calcium carbonate used as filler for paper-making, namely precipitated calcium carbonate manufactured chemically by introducing carbon dioxide into milk of lime and heavy calcium carbonate manufactured by mechanically smashing lime stone and subsequent classification. Lime stone used as material of heavy calcium carbonate is roughly divided into two kinds. One kind is chalk obtained in Europe in large quantities. Not subjected to thermal metamorphism due to earth's magma activity, it is easily smashable, the resulting particle size is relatively uniform and there are scarcely any knife edge-like projections on the surface of particles. That the neutral paper-making process by the use of plastic wires has been widely adopted in Europe is because chalk of less abrasive effect on plastic wires has been readily available.

The other kind of lime stone is hard lime stone subjected to thermal metamorphism due to magma activity, so-called marble, and the greater part of lime stone used in Japan as material of heavy calcium carbonate belongs to this type. The particles of heavy calcium carbonate made from this marble type of lime stone are amorphous having many knife edges on the surface of particles, hence it is highly abrasive on plastic wires and is less suited as filler for neutral paper-making process by the use of plastic wires.

Precipitated calcium carbonate, which is manufactured chemically, is uniform in particle size, has fewer knife edges on the surface of particles and is relatively narrow in the width of particle size distribution. Compared with heavy calcium carbonate, therefore, it is less abrasive on plastic wires and is widely used as filler for rice paper and India paper. It is, however, inevitably dearer because of its manufacturing process, is low in yield because of its fine particle size and cannot impart enough strength to the paper made, hence it is less suited as filler for the neutral paper-making process and its use is limited to where it is used as substitute for expensive titanium oxide or as filler for papers of high added values such as information recording paper.

Heavy calcium carbonate, which is easier to manufacture than precipitated calcium carbonate, is cheaper but, when it is made from marble type lime stone obtained in Japan as mentioned above, the resulting particles are irregular, have many knife edges on the surface thereof and, when it is used as filler for neutral paper-making process, marked abrasive effect on plastic wires of the paper-making machine is inevitable. It is also possible to use heavy calcium carbonate extremely small in particle size with reduced abrasive effect on plastic wires as filler for neutral paper-making process. The industrial production of such fine particle size heavy calcium carbonate is, however, very small, its cost is even higher than that of talc, its yield in paper is lower with decreasing particle size and with that also decreases the strength of the paper, hence this can hardly be a good method.

For the above reasons, no heavy calcium carbonate has been available in Japan, which is similar to chalk of favorable behavior with regard to abrasive wear of plastic wires comparable with precipitated calcium carbonate. Hence, despite the well recognized merits of the neutral paper-making and the use of plastic wires, the neutral paper-making process by the use of plastic wires has not been adopted in earnest and the development of a method for mass-producing heavy calcium carbonate which is cheap, rated the same as or even lower than chalk in abrasive effect on plastic wires, favorable in yield and free of the effect of lowering the whiteness and strength of the paper made has been looked forward to, and extensive and intensive efforts have been made for this end.

In the specification of Laid-open Patent Application No. 144296/'83, for instance, it is claimed that the shape of particles of heavy calcium carbonate can be rounded by sand-milling to crumble off the knife edges formed in the surface. The method, however, calls for sand-milling a 30–85% aqueous suspension of heavy calcium carbonate once or even a plurality of times, which means a substantial increase in energy cost, and, moreover, the suspending agent used for improving the efficiency of sand-milling can possibly cause marked deterioration of the yield of the paper-making process.

SUMMARY OF THE INVENTION

It is an object of the present invention to provide a filler for paper-making cheap and remarkably low in abrasive effect on plastic wires.

Another object of the present invention is to provide a neutral paper-making process which is cheap and remarkably reduced in abrasive effect on plastic wires.

Further objects and advantages of the present invention will be apparent from the detailed description below.

After extensive and intensive studies the present inventors have discovered that a particle composition of specific physical properties can meet the above-mentioned objects and have thereby arrived at the present invention.

DETAILED DESCRIPTION OF THE INVENTION

Figure 1:
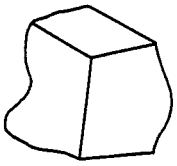
FIGS. 1 through 4 are diagrammatic views showing the construction of particles.

The first object of the present invention is to provide a filler for paper-making composed of 0.1 weight part or more of a particle composition meeting the requirements (A), (B) and (C) below per 100 weight parts of heavy calcium carbonate.

(A): Zeta potential (Suspension concentration 1,000 ppm in pure water, measuring temperature 20° C.) is negative;

(B): Particle size "d" of the composition resulting from dispersion for 10 minutes of a 10 weight % aqueous suspension of the above-mentioned particle composition by ultrasonic dispersing means measured by the use of the standard sieve of JIS Z8801 is:

$$22\ \mu m < d \leqq 150\ \mu m$$

(C): Specific surface area S ($cm^2/g$) of the above-mentioned particle composition measured by the BBT method is within the range shown by the formula (1) below:

$$S > 100{,}000/D \cdot \rho \quad (1)$$

where:

D=Average particle size (μm) of the composition

ρ=Specific gravity of the composition (D and ρ in the formula (1) above are measured by the following methods respectively:

D: 10 weight % aqueous suspension of the above-mentioned suspension is further dispersed for 10 minutes by ultrasonic dispersion means and then it is passed through a 125 μm (119 mesh) sieve, the sifted portion is then passed through a 100 μm (149 mesh) sieve and thereafter the same procedure is repeated with sieves of 75 μm(200 mesh), 45 μm (330 mesh) and 22 μm (580 mesh) in this order, the portion which has passed the 22 μm sieve is diluted with water to a 0.5 weight % aqueous suspension, which is then passed through a micro-sieve of 15 μm and the 7 classified portions having trapped by the respective sieves and micro-sieve and having passed the micro-sieve 15 μm are dried and weighed, the weight % against the total weight of each portion or class is determined, the mean value for the particle size of each class is set as listed in the Table 1 below, and the value D is calculated by the formula 2 below.

TABLE 1

| Class | Dry weight (%) | Mean particle size (μm) |
|---|---|---|
| 125 μm n.pass | $W_1$ | $d_1$ = 135.0 |
| 125 μm pass - 100 μm n.pass | $W_2$ | $d_2$ = 112.5 |
| 100 μm pass - 75 μm n.pass | $W_3$ | $d_3$ = 87.5 |
| 75 μm pass - 45 μm n.pass | $W_4$ | $d_4$ = 60.0 |
| 45 μm pass - 22 μm n.pass | $W_5$ | $d_5$ = 33.5 |
| 22 μm pass - 15 μm n.pass | $W_6$ | $d_6$ = 18.5 |
| 15 μm pass | $W_7$ | $d_7$ = 12.5 |

$$D = \Sigma wi/\Sigma(wi/di) \quad (2)$$

ρ: Specific gravity measured by the method described in JIS K 5101 "Pigment dispersing method."

The second object of the present invention is to provide a neutral paper-making process featuring the use of the above-mentioned filler.

Where in connection with the present invention, dolomite type lime stone etc. containing magnesium carbonate is used, calculation is to be made with the assumption that calcium carbonate and magnesium carbonate are equally effective.

According to the present invention, the particle composition added to heavy calcium carbonate may be appropriately selected from the natural or synthetic compositions satisfying the requirements (A), (B) and (C) (hereunder this composition is referred to as "composition A") and there are no other special limitations.

As to the reason why a marked improvement is attained with regard to abrasive wear of plastic wires when the composition A is added to heavy calcium carbonate compared with when heavy calcium carbonate is used alone in paper-making, there still remain a number of questions but it is roughly presumed to be because of the following properties of the composition A, namely:

(1) that the composition A is a particle composition having a negative zeta potential and a particle size more than 10 μm and less than 150 μm, and (2) that the composition A is a composition whose specific surface area S ($cm^2/g$) determined by BET method is $$S > 100{,}000/D \cdot \rho$$

where:

D=Mean particle size of the composition

ρ=Specific gravity of the composition.

Figure 2:
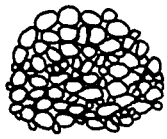
Figure 3:
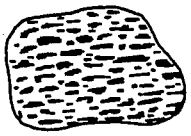
Figure 4:
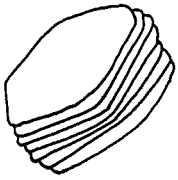
Figure 5:
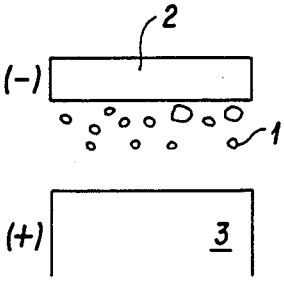
FIGS. 5 through 7 are diagrammatic views showing the mechanism of abrasive wear of plastic wires.
Figure 9:
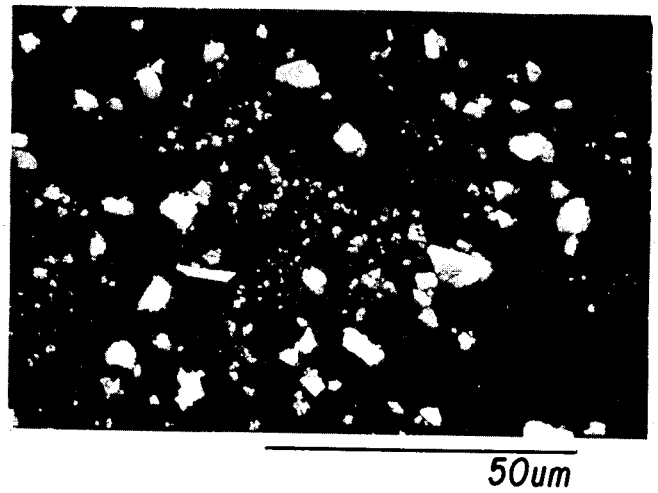
FIGS. 9 through 17 are microscopic pictures showing the particle construction of filler compositions.

Since the specific surface area of the composition as shown in the diagrammatic view of FIG. 1 such as single crystal of quartz sand (consisting of primary particles only) and single crystal of lime stone identical in particle size with the above-mentioned composition is $S = 60{,}000 \pm 20{,}000/D \cdot \rho$, it is presumed that the composition A is composed of an aggregation of fine particles as shown in the diagrammatic view of FIG. 2, 3 or 4, that the surface of the composition A is porous, or that the composition A is of laminar structure. It is apparent also from the microscopic picture of the composition A used in Example 1, 2 and 3 described below. It may be easily understood that the composition A in shapes as shown in the diagrammatic views of FIGS. 2, 3 and 4 are subject to partial disintegration due to external stress compared with the single crystal substance of FIG. 1. As is apparent from FIG. 9 (Super #1500), heavy calcium carbonate generally used for paper-making has contained therein coarse particles 5–8 μm in particle size and, when such heavy calcium carbonate is used alone for paper-making, the abrasive wear of the plastic wires (2) is markedly enhanced for, as shown in the diagrammatic view of FIG. 5, heavy calcium carbonate (1) is generally charged positive in water, hence it is adsorbed to the surface of the plastic wires (2) which are generally charged negative and because of the stress occurring between the plastic wires (2) and the ceramic portion (3) of the paper-making machine the coarse particles of heavy calcium carbonate (2) always cause abrasive wear of the plastic wires. When, on the other hand, the composition A is added to heavy calcium carbonate according to the present invention, the composition A (4) whose particle size is larger than the coarse particles of heavy calcium carbonate is negatively charged in water to be attracted by the positively charged ceramic portion (3) of the paper-making machine so as to sort of retain the plastic wires (2), so that the heavy calcium carbonate (1) is allowed to pass between the plastic wires (2) and the ceramic portion (3) to result in less contact between the heavy calcium carbonate (1) and the wires (2) and less abrasive wear of the plastic wires (2). Furthermore, the composition A (4) acting as wire retainer has such physical properties that it is slowly but progressively disintegrated and dispersed by the stress occurring between the plastic wires (2) and the ceramic portion (3) to thereby effect dispersion of the stress for less risk of direct damage of the plastic wires (2). The synergistic effect of these two phenomena is supposed to markedly reduce the risk of abrasive wear of the plastic wires.

Figure 6:
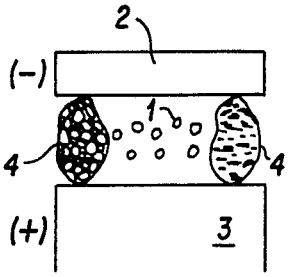
Figure 7:
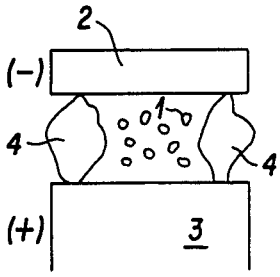

Even if the zeta potential is negative, however, the composition of FIG. 1 is to serve the above-mentioned function retainer for the plastic wires (2) when a composition not satisfying the above-mentioned formula $S > 100{,}000/D \cdot \rho$ as shown in the diagrammatic view of FIG. 1 is used, hence although for the same reason as shown in the diagrammatic view of FIG. 6 the purpose of reducing the abrasive wear of the plastic wires is partly attained, the retainer itself acts directly damaging the wire surface by the reaction of the stress for the composition as the wire retainer is not easily disintegrated and dispersed by the stress occurring between the wires (2) and the ceramic portion (3), this resulting in a marked decrease of the composition's effect to reduce the abrasive wear of the plastic wires.

Figure 8:
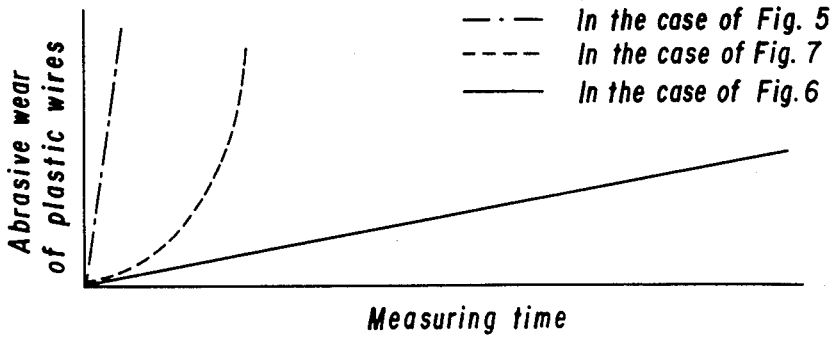
FIG. 8 is a graph showing the relationship between the time and the wear of plastic wires.

In FIG. 8 is shown the relationship between the abrasive wear measuring time and the amount of abrasive wear of plastic wires, determined by the use of Nippon Filcon's filler abrasion tester.

When, according to the present invention, a composition whose zeta potential is positive is used instead of the composition A, the above-mentioned composition as wire retainer as shown in the diagrammatic view of FIG. 6 is attracted by the plastic wires, this resulting in an increased frequency of contact between the wire retainer and the plastic wires, which causes an increased risk of damage to the wires.

When a composition 10 μm or less in particle size is used instead of the composition A, it cannot fully exhibit its function as wire retainer for its particle size is similar to that of the coarse particles of heavy calcium carbonate and can hardly be effective in reducing the abrasive wear of the plastic wires, while, when the particle size of the composition used is more than 150 μm, it interferes with surface smoothness of the paper made, this giving cause for troubles in the printing process etc. and being not advisable.

According to the present invention, the addition of the composition A is to the extent of 0.1 weight part or more per 100 weight parts of heavy calcium carbonate, preferably 1–30 weight parts, and the object of the present invention cannot be fully accomplished at less than 0.1 weight part. There is no particular upper limit, but it may preferably be some 50 weight parts with the paper's smoothness, strength etc. taken into consideration.

As mentioned above, the present invention consists essentially of in the use of the composition A of the specific physical properties together with heavy calcium carbonate, which enables a dramatic decrease of the abrasive wear of plastic wires compared with the case in which heavy calcium carbonate is used alone as filler for paper-making. Thus, the present invention enables the use of heavy calcium carbonate a step smaller in specific surface area (or larger in mean particle size), which is cheaper than the hitherto used counterpart, without sacrificing the paper strength or yield, thus providing an ideal filler for paper-making and an ideal paper-making process.

Given hereunder are Examples of the present invention together with Control Examples for concretely explaining the features thereof but, needless to say, the present invention is by no means limited thereby.

The abrasive wear of plastic wires was determined by bringing paper-making wires made of plastic (Nippon Filcon's OS-H60) with a 0.85 kg weight attached thereto into contact with a ceramic roll, feeding onto the wires a suspension with a filler concentration of 2 weight % at a rate of 1 liter/min. with the roll being driven at a speed of 283 m/min. and measuring the weight loss of the wires after the lapse of a given length of time, and it was recorded as the amount of abrasive wear of the plastic wires for paper-making.

The zeta potential was measured of a slurry of 1,000 ppm. prepared by suspending 2 g of dry specimen by the use of "LASER ZEE Mode 501." The specific gravity was measured by the method of JIS K 5101-1978. For measurement of the particle size and mean particle size of the composition A were used sieves and micro-sieve of JIS Z 8801-1982. Further, for aqueous dispersion of the composition A etc. of the present invention was used the desk type ultrasonic dispersing machine VS-50 set to a resonance frequency of 35 KHz±2KHz.

EXAMPLE 1

A domestic (Japanese) talc known to be based on chlorite, talc, amphibole, montmorillonite etc. as the result of X-ray diffraction test (trade name "S Talc." maker: Fukuoka Talc) in powder form was dispersed in water to a 10 weight % aqueous suspension. After further dispersion for 10 minutes by the use of an ultrasonic dispersing machine particles coarser than 150 μm were separated by a 100 mesh (150 μm) sieve and then the portion having passed the 100 mesh (150 μm) sieve was classified into two classes, one coarser than 22 μm and the other not coarser than 22m. The portion having passed the 580 mesh (22 μm) sieve containing fine particles 22 μm or under in particle size was diluted with water to an aqueous suspension of 0.5 weight %, fine particles 10 μm or under were separated by the use of a micro-sieve of 10 μm and by mixing the portion not passing the 10 μm micro-sieve and the portion not passing the 580 mesh (22 μm) sieve suspension of a composition with a particle size (d) range of $10\ \mu m < d \leqq 150\ \mu m$.

10 weight parts of this composition A were added to 100 weight parts of heavy calcium carbonate (trade name "Super #1500," maker: Maruo Calcium), specific surface area measured by constant pressure aeration method = 14,500 $cm^2/g$) to prepare a filler composition for paper-making, and with this the abrasive wear of plastic wires was measured. The measured value is shown in Table 3.

In this Example, the mean particle size D of the suspension of the composition added to heavy calcium carbonate measured by the use of sieves 125 μm, 100 μm, 75 μm, 45 μm and 22 μm and a micro-sieve 15 μm was 22 μm, the specific gravity measured by the method of JIS K 5101 was $\rho = 2.79$, the zeta potential of the powder obtained by drying the suspension of the above-mentioned composition was −28mV and the specific surface area S measured by the use of Shibata Kagaku's BET (Method) Specific Surface Area Tester Model P-700 was 4,500 $cm^2/g$.

From this result it was confirmed that $S > 100{,}000 > D \cdot \rho$.

Figure 10:
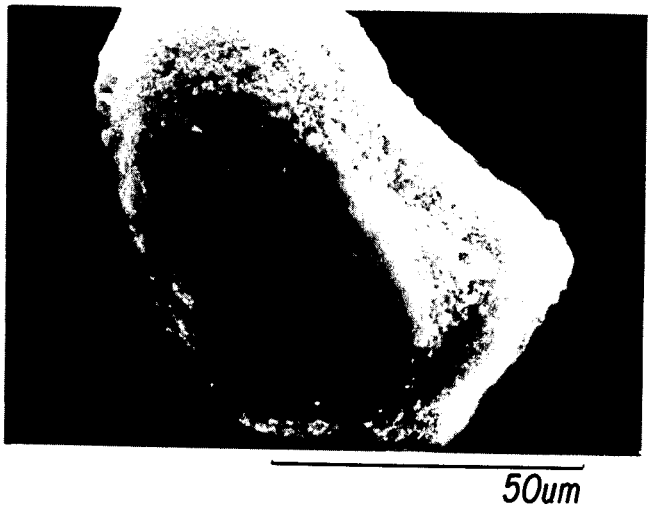
Figure 11:
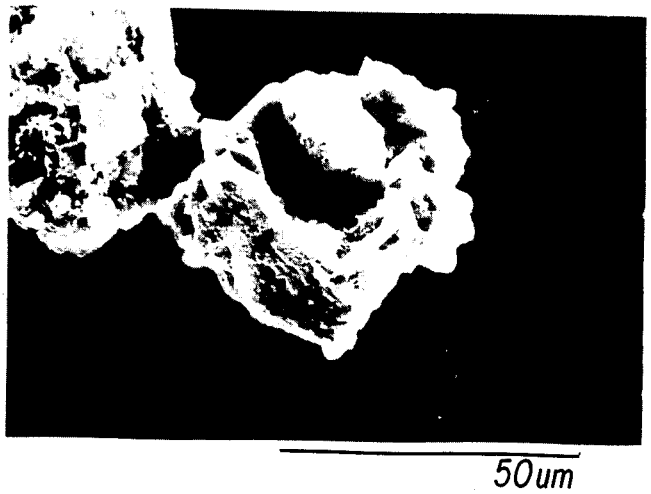
Figure 12:
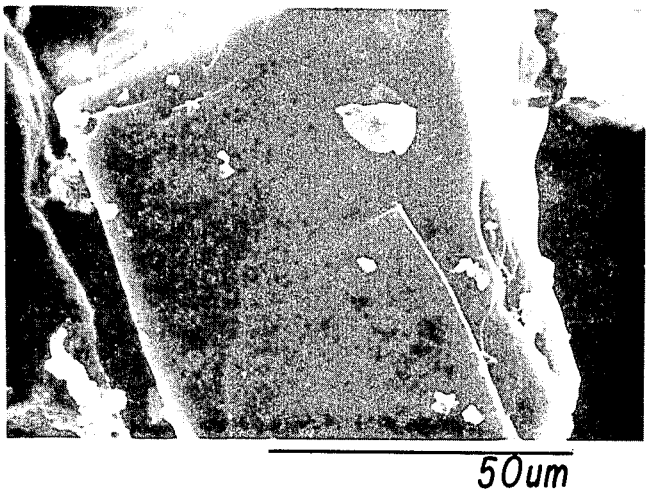

The electron microscopic pictures of the composition A added to heavy calcium carbonate are shown in FIGS. 10–12. This means that the composition A is primarily composed of particles in three different structures shown in FIGS. 10, 11 and 12 respectively.

EXAMPLE 2

Figure 13:
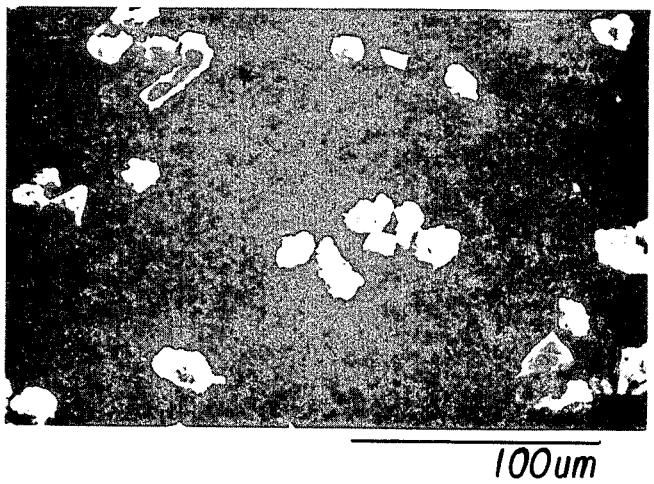
Figure 14:
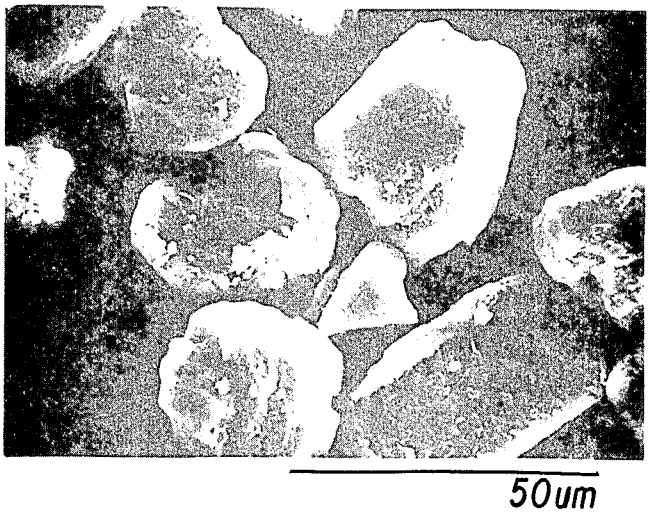

Talc (Trade name: D-35, maker: Fuji Talc) was dispersed in water to a 10 weight % aqueous suspension and after further dispersion thereof by the use of an ultrasonic dispersing machine the suspension of a composition with a particle size (d) range of 10 $\mu m < d \leqq 150$ $\mu m$ was obtained in the same way as Example 1. FIG. 13 shows its electron microscopic picture and FIG. 14 an enlarged picture thereof.

4 weight parts of this composition A were added to solid to 100 weight parts of heavy calcium carbonate "Super #1500" for preparation of a filler composition for paper-making and with it was measured the abrasive wear of plastic wires. The measured value is shown in Table 3.

The characteristics of the composition added to heavy calcium carbonate in this Example were measured in the same way as in Example 1. The mean particle size was $D=34$ $\mu m$, specific gravity was $\rho=2.74$, BET specific surface area was $S=2{,}460$ $cm^2/g$ and zeta potential was $-14$ mV.

EXAMPLE 3

Commercially available bentonite (trade name: "Akagi," maker: Hojun Yoko) in powder form was dispersed in water and 20 weight % bentonite suspension was prepared by subsequent stirring for 10 minutes at 100 rpm. The suspension so prepared was allowed to stand for 24 hours for the coarser particles to sediment, 24 hours after start of sedimentation the clear top was removed and the resulting sediment was diluted with water to a 10 weight % suspension of the sediment.

This suspension of the sediment was further dispersed for 10 minutes by the use of an ultrasonic dispersing machine and a suspension with a particle size (d) range of 10 $\mu m < d \leqq 150$ $\mu m$ was obtained.

4 weight parts of this composition A were added as a solid to 100 weight parts of heavy calcium carbonate (trade name: "Super 3S," maker: Maruo Calcium), specific surface area measured by constant pressure aeration method: 11,500 $cm^2/g$) to prepare a filler composition for paper-making and with it the abrasive wear of plastic wires was measured. The measured value is shown in Table 3.

The characteristics of the composition added to heavy calcium carbonate in the Example was measured in the same way as Example 1. The mean particle size was $D=47$ $\mu m$, specific gravity was $\rho=2.41$, BET specific surface area was $S=7{,}900$ $cm^2/g$ and zeta potential was $-23$ mV.

EXAMPLE 4

A gas containing 25% carbon dioxide was passed through milk of lime consisting of 19% aqueous suspension of $Ca(OH)_2$ 30° C. at a flow rate of 0.3 liter/lg $Ca(OH)_2$ for carbonation reaction to proceed until the pH of the liquid reached 6.8, and an aqueous suspension of calcium carbonate was obtained. To this aqueous suspension of calcium carbonate the equal volume of the above lime of milk was added and the carbonation reaction was conducted in the same way. This procedure was repeated a total of 5 times.

The resulting aqueous suspension of calcium carbonate was heated to 85° C., a 10% solution of water glass #3 was dripped into it and the carbon dioxide containing gas was passed through it until its pH reached 8.0 for fine amorphous silica to deposit on the surface of calcium carbonate and the dripping of the water glass (#3) solution and passage of the carbon dioxide containing gas were stopped when $SiO_2$ in the suspension reached 17 weight parts per 100 weight parts of calcium carbonate.

The resulting suspension of silica-coated calcium carbonate was dehydrated by the use of a filter press and upon drying thereof was obtained a white powder.

Then, the white powder of silica-coated calcium carbonate was dispersed in water to prepare a 10 weight % aqueous suspension and after further dispersion thereof by the use of an ultrasonic dispersing machine the suspension of a composition with a particle size (d) range of 10 $\mu m < d \leqq 150$ $\mu m$ was obtained in the same way as in Example 1.

This composition A was added as solid 10 weight parts to 100 weight parts of heavy calcium carbonate "Super 3S" to prepare a filler composition for paper-making and with it the abrasive wear of plastic wires was measured. The measured value is shown in Table 3.

The characteristics of the composition added to heavy calcium carbonate in this exmaple were measured in the same way as Example 1. The mean particle size was $D=21$ $\mu m$, specific gravity was $\rho=2.63$, BET specific surface area was $S=89{,}000$ $cm^2/g$ and zeta potential was $-20$ mV.

EXAMPLE 5

Figure 15:
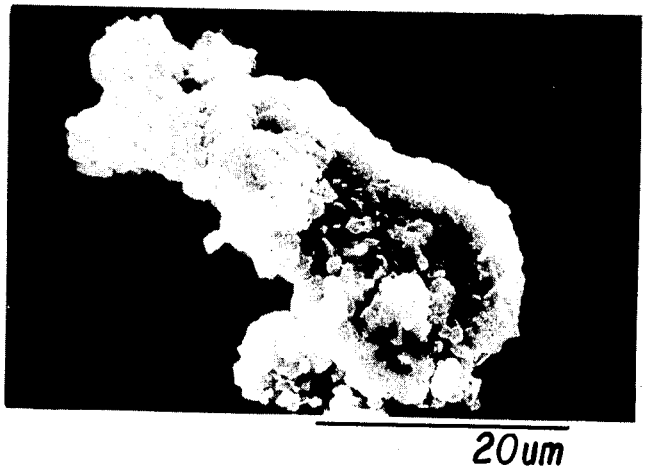

The ore specimen of chalk sold by Nippon Chikagaku-Sha was ground in a grinder, the resulting powder was dispersed in water to prepare a 10 weight % aqueous suspension and an aqueous suspension with a particle size (d) range of 10 $\mu m < d \leqq 150$ $\mu m$ was obtained in the as Example 1. Its electron microscopic picture is shown in FIG. 15.

This composition A was added as solid 30 weight parts to 100 weight parts of heavy calcium carbonate "Super 3S" to prepare a filler composition for paper-making and with it the abrasive wear of plastic wires was measured. The measured value is shown in Table 3.

The characteristics of the composition added to heavy calcium carbonate in this Example were measured in the same way as Example 1. The mean particle size was $D=29$ $\mu m$, specific gravity was $\rho=2.55$, BET specific surface area was $S=4{,}700$ $cm^2/g$ and zeta potential was $-4$ mV.

REFERENCE EXAMPLES 1–3

The abrasive wear of plastic wires was measured by the use of each of heavy calcium carbonates of different particle sizes "Super 3S," "Super #1500" and "Super #2000" (maker: Maruo Calcium, specific surface area measured by constant pressure aerating method 11.500 $cm^2/g$, 14,500 $cm^2/g$ and 19,300 $cm^2/g$ respectively). The measured values are shown in Table 3.

CONTROL EXAMPLE 1

Figure 16:
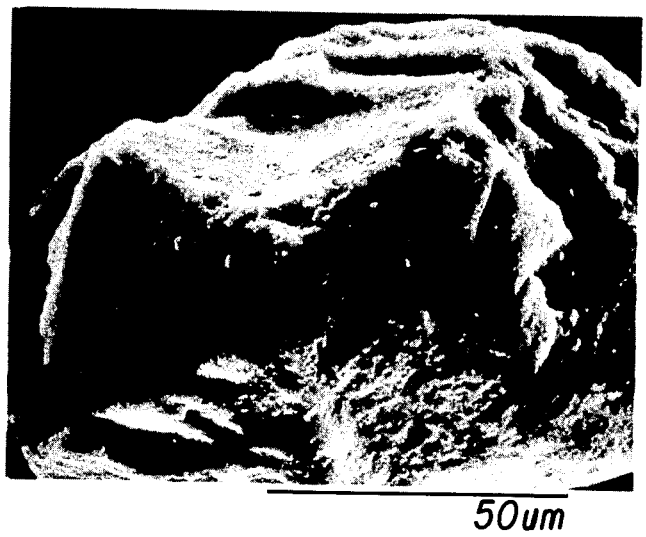

Heavy calcium carbonate of coarse particle size (trade name: "R Jutan," maker: Maruo Calcium, specific surface area measured by constant pressure aeration method: 1,900 $cm^2/g$) was dispersed in water to prepare a 10 weight % aqueous suspension and after further dispersion thereof by the use of an ultrasonic dispersing machine the suspension of a composition with a particle size (d) range of 10 $\mu m < d \leqq 150$ $\mu m$ was obtained. Its electron microscopic picture is shown in FIG. 16.

This composition was added as solid 10 weight parts to 100 weight parts of heavy calcium carbonate "Super 3S" to prepare a filler composition for paper-making and with it the abrasive wear of plastic wires was measured. The measured value is shown in Table 3.

The characteristics of the composition added to heavy calcium carbonate in this Control Example were measured in the same way as Example 1. The mean particle size was D=47 μm, specific gravity was ρ=2.65, BET specific surface area was S=760 $cm^2/g$ and zeta potential was +40 mV.

CONTROL EXAMPLE 2

Figure 17:
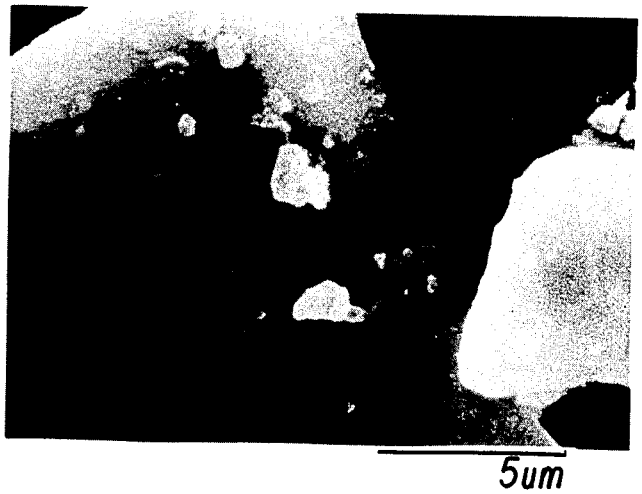

Quartz sand powder (trade name: "KI Clay," maker: Yamamori Tsuchimoto K.K.) was dispersed in water to prepare a 10 weight % aqueous suspension and after further dispersion thereof by the use of an ultrasonic dispersing machine the suspension of a composition with a particle size (d) range of 10 μm<d≦150 μm was obtained. Its electron microscopic picture is shown in FIG. 17.

This composition was added as solid 5 weight parts to 100 weight parts of heavy calcium carbonate "Super 3S" to prepare a filler composition for paper-making and with it the abrasive wear of plastic wires was measured. The measured value is shown in Table 3.

The characteristics of the composition added to heavy calcium carbonate in this Control Example were measured in the same way as Example 1. The mean particle size was D=18 μm, specific gravity was ρ=2.53, BET specific surface area was S=1,730 $cm^2/g$ and zeta potential was −26 mV.

CONTROL EXAMPLE 3

The 10 weight % aqueous suspension of talc "D-35" prepared in Example 2 was further dispersed by the use of an ultrasonic dispersing machine and then classified by the use of a 10 μm micro-sieve, and thus the dispersion of a composition with a particle size (d) range of d≦10 μm was obtained. This composition was added as solid 10 weight parts to 100 weight parts of heavy calcium carbonate "Super #1500" to prepare a filler composition for paper-making and with it the abrasive wear of plastic wires was measured. The measured value is shown in Table 3.

The characteristics of the composition added to heavy calcium carbonate in this Control Example were: the mean particle size was D≦10 μm, specific gravity was ρ=2.69, BET specific surface area was S=54,000 $cm^2/g$ and zeta potential was −18 mV.

CONTROL EXAMPLE 4

The same composition as added to heavy calcium carbonate in Example 1 was added as solid 0.01 weight part to 100 weight parts of heavy calcium carbonate "Super#1500" to prepare a filler composition for paper-making and with it the abrasive wear of plastic wires was measured. The measured value is shown in Table 3.

TABLE 2

| | Composition added to heavy calcium carbonate | | | | | |
|---|---|---|---|---|---|---|
| | Zeta Potential (mV) | Mean particle size (μm) | Specific gravity (ρ) | 100000 D.ρ | BET Specific Surface Area ($cm^3/g$) | Parts added per 100 parts heavy calcium carbonate |
| Example 1 | −28 | 22 | 2.79 | 1,629 | 4,500 | 10 |
| Example 2 | −14 | 34 | 2.74 | 1,073 | 2,460 | 4 |
| Example 3 | −23 | 47 | 2.41 | 883 | 7,900 | 4 |
| Example 4 | −20 | 21 | 2.63 | 1,810 | 89,000 | 10 |
| Example 5 | −4 | 29 | 2.55 | 1,352 | 4,700 | 30 |
| Cont. Example 1 | +40 | 47 | 2.65 | 803 | 760 | 10 |
| Cont. Example 2 | −26 | 18 | 2.53 | 2,196 | 1,730 | 5 |
| Cont. Example 3 | −18 | ≦10 | 2.69 | (*) | 54,000 | 10 |
| Cont. Example 4 | −28 | 22 | 2.79 | 1,629 | 4,500 | 0.01 |

(*) Immeasurable

TABLE 3

| | Heavy calcium carbonate used | | Plastic wire abrasive wear test results *2 | | | | | | | |
|---|---|---|---|---|---|---|---|---|---|---|
| | Trade name | Specific surface are *1 | Abrasive wear (mg) of wire as function of measuring time (min.) | | | | | | | Wire breakage time (min.) *3 |
| | | | 15 | 30 | 60 | 90 | 120 | 150 | 180 | |
| Example 1 | Super #1500 | 14,500 | 6.0 | 8.1 | 19.3 | 40.0 | 87.5 | 131.2 | 186.3 | — |
| Example 2 | Super #1500 | 14,500 | 15.0 | 33.3 | 86.9 | 134.2 | 191.7 | — | — | — |
| Example 3 | Super 3S | 11.500 | 10.2 | 20.0 | 41.5 | 57.6 | 75.4 | 94.0 | 113.8 | — |
| Example 4 | Super 3S | 11,500 | 15.1 | 30.3 | 66.1 | 117.5 | 189.3 | — | — | — |
| Example 5 | Super 3S | 11,500 | 23.3 | 33.2 | 58.3 | 93.4 | 135.7 | 194.6 | — | — |
| Cont. Example 1 | Super 3S | 11,500 | 70.8 | 146.1 | — | — | — | — | | 74 |
| Cont. Example 2 | Super 3S | 11,500 | 29.7 | 79.3 | — | — | — | — | — | 83 |
| Cont. Example 3 | Super #1500 | 14,500 | 63.0 | 138.4 | — | — | — | — | — | 90 |
| Cont. Example 4 | Super #1500 | 14,500 | 76.0 | 145.0 | — | — | — | — | — | 82 |
| Ref. Example 1 | Super 3S | 11,500 | 80.4 | 168.9 | — | — | — | — | — | 70 |
| Ref. Example 2 | Super #1500 | 14,500 | 76.6 | 144.6 | — | — | — | — | — | 80 |
| Ref. Example 3 | Super #2000 | 19,300 | 61.8 | 113.0 | 203.1 | — | — | — | — | 120 |

*1 Specific surface area measured by the constant pressure aeration method ($cm^2/g$)
*2 The abrasive wear of plastic wires beyond 200 mg is not recorded for the weft is then bound to be broken.
*3 The wire breaking time beyond 180 minutes after the start of measurement was not measured.

What is claimed is:

1. A filler composition for paper-making comprising 100 weight parts of particles of heavy calcium carobnate and at least 0.1 weight parts of a particle composition consisting of particles meeeting the requirements (A), (B) and (C):

(A) the zeta potential (Suspension concentration 1,000 ppm in pure water, measuring temperature 20° C.) is negative;

(B) the particle size "d" of the particle composition resulting from dispersion for 10 minutes of a 10 weight % aqueous suspension of said particle composition by ultrasonic dispersing means measured by the use of the standard sieve and micro-sieve of JIS Z8801 is 10 μm<d≦150 μm;

(C) the specific surface area S ($cm^2/g$) of the particles of said particle composition measured by the BBT method is within the range shown by the formula $$S > 100{,}000/D\rho \quad (1)$$

wherein

D=Average particle size (μm) of the composition

ρ=Specific gravity of the composition

D being measured by the following method, wherein a 10 weight % aqueous suspension of said suspension of the particle composite: is further dispersed for 10 minutes by ultrasonic dispersion means and then is passed through a 125 μm (119 mesh) sieve, the sifted portion is then passed through a 100 μm (149 meash) sieve and thereafter the same procedure is repeated with sieves of 75 μm (200 mesh), 45 μm (330 mesh) and 22 μm (580 mesh) in this order, the portion which has passed the 22 μm sieve is diluted with water to a 0.5 weight % aqueous suspension, which is then passed through a micro-sieve of 15 μm and the 7 classified portions having been trapped by said respective sieves and micro-sieve and having passed said micro-sieve of 15 μm are dried and weighted, the weight % against the total weight of each portion or class is determined, the mean value for the particle size of each class is set as listed in the Table 1 below, and the value D is caluculated by the formula 2 below,

TABLE 1

| Class | Dry weight (%) | Mean particle size (μm) |
|---|---|---|
| 125 μm n.pass | $W_1$ | $d_1$ = 135.0 |
| 125 μm pass - 100 μm n.pass | $W_2$ | $d_2$ = 112.5 |
| 100 μm pass - 75 μm n.pass | $W_3$ | $d_3$ = 87.5 |
| 75 μm pass - 45 μm n.pass | $W_4$ | $d_4$ = 60.0 |
| 45 μm pass - 22 μm n.pass | $W_5$ | $d_5$ = 33.5 |
| 22 μm pass - 15 μm n.pass | $W_6$ | $d_6$ = 18.5 |
| 15 μm pass | $W_7$ | $d_7$ = 12.5 |

$$D = \Sigma wi/\Sigma(wi/di) \quad (2)$$

and ρ being measured by the method in JIS K 5101 "Pigment dispersing method."

2. A neutral paper-making process, wherein a filler composition for paper-making comprising 100 weight parts of heavy calcium carbonate and at least 0.1 weight parts of a particle composition consisting of particles meeting the requirements (A), (B) and (C) is used, wherein (A) the zeta potential (Suspension concentration 1,000 ppm in pure water, measuring temperature 20° C.) is negative;

(B) the particle size "d" of the particle composition resulting from dispersion for 10 minutes of a 10 weight % aqueous suspension of said particle composition by ultrasonic dispersing means measured by the use of the standard sieve and micro-sieve of JIS Z8801 is 10 μm<d≦150 μm;

(C) the specific surface area S ($Cm^2/g$) of the particles of said particle composition measured by the BBT method is within the range shown by the formula $$S > 100{,}000/D\cdot\rho \quad (1)$$

wherein

D=Average particle size (μm) of the composition

ρ=Specific gravity of the composition

D being measured by the method, wherein a 10 weight % aqeous suspension of said suspension of the particle composition is further dispersed for 10 minutes by ultrasonic dispersion means and then is passed through a 125 μm (119 mesh) sieve, the sifted portion is then passed through a 100 μm (149 mesh) sieve and therafter the same procedure is repeated with sieves of 75 μm (200 mesh), 45 μm (330 mesh) and 22 μm (580 mesh) in this order, the portion which has passed the 22 μm sieve is diluted with water to a 0.5 weight % aqueous suspension, which is then passed through a micro-sieve of 15 μm and the 7 classified portions having been trapped by said respective sieves and micro-sieve and having passed said micro-sieve of 15 μm are dried and weighted, the weight % against the total weight of each portion or class is determined, the mean value for the particle size of each class is set as listed in the Table 1 below, and the value D is calculated by the formula 2 below,

TABLE 1

| Class | Dry weight (%) | Mean particle size (μm) |
|---|---|---|
| 125 μm n.pass | $W_1$ | $d_1$ = 135.0 |
| 125 μm pass - 100 μm n.pass | $W_2$ | $d_2$ = 112.5 |
| 100 μm pass - 75 μm n.pass | $W_3$ | $d_3$ = 87.5 |
| 75 μm pass - 45 μm n.pass | $W_4$ | $d_4$ = 60.0 |
| 45 μm pass - 22 μm n.pass | $W_5$ | $d_5$ = 33.5 |
| 22 μm pass - 15 μm n.pass | $W_6$ | $d_6$ = 18.5 |
| 15 μm pass | $W_7$ | $d_7$ = 12.5 |

$$D = \Sigma wi/\Sigma(wi/di) \quad (2)$$

and being measured by the method described in JIS K 5101 "Pigment dispersing method."

* * * * *